US011969133B2

(12) United States Patent
Conrad

(10) Patent No.: US 11,969,133 B2
(45) Date of Patent: Apr. 30, 2024

(54) HAND VACUUM CLEANER

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 18/376,901

(22) Filed: Oct. 5, 2023

(65) Prior Publication Data

US 2024/0074628 A1 Mar. 7, 2024

Related U.S. Application Data

(63) Continuation of application No. 17/401,180, filed on Aug. 12, 2021, which is a continuation of application
(Continued)

(30) Foreign Application Priority Data

Mar. 11, 2009 (CA) ..... 2658029
Mar. 11, 2009 (CA) ..... 2658048

(51) Int. Cl.
*A47L 5/24* (2006.01)
*A47L 9/00* (2006.01)
(Continued)

(52) U.S. Cl.
CPC ..... *A47L 5/24* (2013.01); *A47L 9/00* (2013.01); *A47L 9/106* (2013.01); *A47L 9/1691* (2013.01)

(58) Field of Classification Search
CPC ... A47L 5/24; A47L 5/28; A47L 5/362; A47L 9/10; A47L 9/102
See application file for complete search history.

(56) References Cited

U.S. PATENT DOCUMENTS 3,320,727 A 5/1967 Farley et al.
3,543,325 A 12/1970 Hamrick
(Continued)

FOREIGN PATENT DOCUMENTS

CA 2658014 A1 9/2010
CN 85201464 U 2/1986
(Continued)

OTHER PUBLICATIONS

English machine translation of JP2000083879, published on Mar. 28, 2000.
(Continued)

*Primary Examiner* — Eric J Rosen
*Assistant Examiner* — John C Merino
(74) *Attorney, Agent, or Firm* — Philip C. Mendes Da Costa; BERESKIN & PARR LLP/S.E.N.C.R.L., s.r.l.

(57) ABSTRACT

A hand vacuum cleaner has a cyclonic unit comprising a first cyclonic stage and a second cyclonic stage. The front end of the first cyclonic stage has a front door that is moveable between a closed position and an open position. A latch secures the front door in the closed position. The front door has a first portion which is rotatably mounted to a front end of a cyclone unit sidewall and a second portion angularly spaced around the front door from the first portion, the second portion having the latch.

19 Claims, 9 Drawing Sheets

Related U.S. Application Data

No. 15/015,036, filed on Feb. 3, 2016, now Pat. No. 11,253,119, which is a continuation of application No. 13/255,858, filed as application No. PCT/CA2010/000340 on Mar. 9, 2010, now Pat. No. 9,591,952.

(51) Int. Cl.
*A47L 9/10* (2006.01)
*A47L 9/16* (2006.01)

(56) References Cited

U.S. PATENT DOCUMENTS 4,279,355 A 7/1981 Schwartz et al.
4,523,936 A 6/1985 Disanza
D280,033 S 8/1985 Miyamoto et al.
D290,894 S 7/1987 Miyamoto et al.
4,704,765 A 11/1987 Ataka
D298,875 S 12/1988 Nakamura
D303,173 S 8/1989 Miyamoto et al.
4,905,342 A 3/1990 Ataka
5,035,024 A 7/1991 Steiner
5,287,591 A 2/1994 Rench
5,307,538 A 5/1994 Rench
5,363,535 A 11/1994 Rench
5,367,740 A 11/1994 McCray
D353,917 S 12/1994 Hoekstra et al.
5,379,483 A 1/1995 Pino
5,839,157 A 11/1998 Strauser et al.
D436,699 S 1/2001 Makihara et al.
6,228,260 B1 5/2001 Conrad et al.
6,375,696 B2 4/2002 Wegelin et al.
6,406,505 B1 6/2002 Oh et al.
6,434,785 B1 8/2002 Vandenbelt et al.
6,546,592 B1 4/2003 Cockburn et al.
6,613,129 B2 9/2003 Gen
6,712,868 B2 * 3/2004 Murphy ..... A47L 5/36 55/482
6,740,144 B2 5/2004 Conrad et al.
6,766,558 B1 7/2004 Matsumoto et al.
D498,027 S 11/2004 Alsruh et al.
6,840,972 B1 1/2005 Kim
6,883,202 B2 4/2005 Steffen et al.
6,974,488 B2 12/2005 Dyson
6,991,666 B2 1/2006 Organ
7,028,369 B2 4/2006 Park et al.
7,370,387 B2 5/2008 Walker et al.
7,445,655 B2 11/2008 Bck et al.
7,485,164 B2 2/2009 Jeong et al.
7,488,362 B2 2/2009 Jeong et al.
D591,466 S 4/2009 Crawley
7,526,833 B2 5/2009 Cochran et al.
7,544,224 B2 6/2009 Tanner et al.
7,845,046 B2 12/2010 Milligan et al.
7,887,612 B2 2/2011 Conrad
D635,728 S 4/2011 Fjellman
7,931,716 B2 4/2011 Oakham
8,100,999 B2 1/2012 Ashbee et al.
8,117,712 B2 2/2012 Dyson et al.
8,127,398 B2 3/2012 Conrad
8,156,609 B2 4/2012 Milne et al.
8,220,109 B2 7/2012 Medema et al.
8,236,077 B2 8/2012 Gomiciaga-Pereda et al.
8,255,456 B2 8/2012 Sundarrajan et al.
8,302,250 B2 11/2012 Dyson et al.
8,347,455 B2 1/2013 Dyson et al.
8,387,204 B2 3/2013 Dyson
8,424,154 B2 4/2013 Beskow et al.
8,444,731 B2 5/2013 Gomiciaga-Pereda et al.
8,707,513 B2 4/2014 Ivarsson et al.
2001/0023517 A1 9/2001 Onishi et al.
2002/0189048 A1 12/2002 Maruyama et al.
2004/0020005 A1 2/2004 Odachi et al.
2004/0112022 A1 6/2004 Vuijk
2004/0163201 A1 8/2004 Murphy et al.
2004/0216264 A1 11/2004 Shaver et al.
2005/0081321 A1 4/2005 Milligan et al.
2006/0075598 A1 4/2006 Follegot et al.
2006/0090290 A1 5/2006 Lau
2006/0123590 A1 6/2006 Fester et al.
2006/0130448 A1 6/2006 Han et al.
2006/0137132 A1 6/2006 Orubor
2006/0137304 A1 6/2006 Jeong et al.
2006/0137309 A1 6/2006 Jeong et al.
2006/0156508 A1 7/2006 Khalil
2006/0207055 A1 9/2006 Ivarsson et al.
2007/0033765 A1 2/2007 Walker et al.
2007/0067943 A1 3/2007 Makarov
2007/0079473 A1 4/2007 Min et al.
2007/0143953 A1 6/2007 Hwang et al.
2007/0209338 A1 9/2007 Conrad
2007/0246579 A1 10/2007 Blateri
2007/0271724 A1 11/2007 Hakan et al.
2007/0289266 A1 12/2007 Oh
2008/0040883 A1 2/2008 Beskow et al.
2008/0047091 A1 2/2008 Nguyen
2008/0109972 A1 5/2008 Mah et al.
2008/0134460 A1 6/2008 Conrad
2008/0178416 A1 7/2008 Conrad
2008/0190080 A1 8/2008 Oh et al.
2008/0250601 A1 10/2008 Coburn
2008/0256744 A1 10/2008 Rowntreer et al.
2009/0056290 A1 3/2009 Oh et al.
2009/0113663 A1 5/2009 Follows et al.
2009/0165239 A1 7/2009 Frantzen et al.
2009/0165242 A1 7/2009 Lee et al.
2009/0229070 A1 9/2009 Medema et al.
2009/0265877 A1 10/2009 Dyson et al.
2009/0282639 A1 11/2009 Dyson et al.
2009/0307864 A1 12/2009 Dyson
2009/0313958 A1 12/2009 Gomiciaga-Pereda et al.
2010/0045215 A1 2/2010 Hawker et al.
2010/0115726 A1 5/2010 Groff et al.
2010/0154150 A1 6/2010 Mcleod
2010/0229322 A1 9/2010 Conrad
2011/0219566 A1 9/2011 Dyson et al.
2011/0219570 A1 9/2011 Conrad
2011/0219571 A1 9/2011 Dyson et al.
2012/0030896 A1 2/2012 Crouch et al.
2012/0079671 A1 4/2012 Stickney et al.
2012/0304417 A1 12/2012 Riley
2013/0091660 A1 4/2013 Smith
2013/0091661 A1 4/2013 Smith
2013/0091812 A1 4/2013 Smith
2013/0091813 A1 4/2013 Smith
2014/0237768 A1 8/2014 Conrad
2016/0367094 A1 12/2016 Conrad

FOREIGN PATENT DOCUMENTS

CN 1626025 A 10/2005
CN 1895148 A 1/2007
CN 1969739 A 5/2007
CN 101015436 A 8/2007
CN 101061932 A 10/2007
CN 101095604 A 1/2008
CN 201008534 Y 1/2008
CN 101288572 A 10/2008
CN 101448447 A 6/2009
CN 101489453 A 7/2009
CN 101489455 A 7/2009
CN 101489457 A 7/2009
CN 101489461 A 7/2009
CN 101657133 A 2/2010
CN 201523596 U1 7/2010
CN 101822506 A 9/2010
CN 201683850 U 12/2010
CN 102188208 A 9/2011
CN 202173358 U 3/2012
CN 103169420 A 6/2013
CN 203724037 U1 7/2014
CN 102256523 B 11/2014
DE 10110581 C2 11/2003

(56) References Cited

FOREIGN PATENT DOCUMENTS

| | | | | |
|---|---|---|---|---|
| DE | 60201666 | T2 | 6/2006 | |
| DE | 202005020767 | A1 | 8/2006 | |
| DE | 102007011457 | A1 | 10/2007 | |
| DE | 112006003479 | T5 | 12/2008 | |
| DE | 112007003039 | T5 | 10/2009 | |
| DE | 112007003052 | T5 | 1/2010 | |
| DE | 202011003563 | U1 | 5/2011 | |
| DE | 112010001135 | T5 | 8/2012 | |
| EP | 0489468 | A1 | 6/1992 | |
| EP | 1938736 | A2 | 7/2008 | |
| EP | 1356755 | B1 | 5/2012 | |
| GB | 2035787 | B1 | 10/1982 | |
| GB | 2251178 | A | 7/1992 | |
| GB | 2268875 | A | 1/1994 | |
| GB | 2377880 | A | 1/2003 | |
| GB | 2409404 | B1 | 11/2005 | |
| GB | 2440110 | A * | 1/2008 | ..... A47L 5/24 |
| GB | 2466290 | A | 6/2010 | |
| GB | 2441962 | B1 | 3/2011 | |
| GB | 2478614 | B1 | 2/2012 | |
| GB | 2484146 | B1 | 2/2013 | |
| GB | 2478599 | B | 7/2014 | |
| JP | D609203 | S | 9/1983 | |
| JP | D745201 | S | 10/1983 | |
| JP | D649078 | S | 4/1985 | |
| JP | 60220027 | A | 11/1985 | |
| JP | D679295 | S | 5/1986 | |
| JP | D679390 | S | 5/1986 | |
| JP | D679426 | S | 5/1986 | |
| JP | D679806 | S | 5/1986 | |
| JP | 61131720 | | 6/1986 | |
| JP | D706192 | S | 5/1987 | |
| JP | D706193 | S | 5/1987 | |
| JP | D725983 | S | 2/1988 | |
| JP | D726042 | S | 3/1988 | |
| JP | D743619 | S | 6/1988 | |
| JP | D743059 | S | 9/1988 | |
| JP | D743445 | S | 9/1988 | |
| JP | D743603 | S | 9/1988 | |
| JP | D743618 | S | 9/1988 | |
| JP | D743619 | S | 9/1988 | |
| JP | 63246116 | A | 10/1988 | |
| JP | D745200 | S | 10/1988 | |
| JP | D943287 | S | 11/1988 | |
| JP | D64-15020 | S | 1/1989 | |
| JP | 788427 | S | 5/1990 | |
| JP | D787941 | S | 5/1990 | |
| JP | D788426 | S | 5/1990 | |
| JP | 8289861 | A | 11/1996 | |
| JP | 2000083879 | A | 3/2000 | |
| JP | D1115813 | A | 7/2001 | |
| JP | 2004121722 | A | 4/2004 | |
| JP | 2004351234 | A | 12/2004 | |
| JP | D1310024 | A | 9/2007 | |
| JP | D1370915 | A | 10/2009 | |
| JP | 2009261501 | A | 11/2009 | |
| JP | 2010081968 | A | 4/2010 | |
| JP | 2010227287 | A | 10/2010 | |
| KR | 1020030060539 | A | 7/2003 | |
| KR | 300360565 | A | 9/2004 | |
| KR | 1020050091821 | A | 9/2005 | |
| KR | 1020050091824 | A | 9/2005 | |
| KR | 1020050091826 | A | 9/2005 | |
| KR | 1020050091829 | A | 9/2005 | |
| KR | 1020050091830 | A | 9/2005 | |
| KR | 1020050091833 | A | 9/2005 | |
| KR | 1020050091834 | A | 9/2005 | |
| KR | 1020050091835 | A | 9/2005 | |
| KR | 1020050091836 | A | 9/2005 | |
| KR | 1020050091837 | A | 9/2005 | |
| KR | 1020050091838 | A | 9/2005 | |
| KR | 1020050103343 | A | 10/2005 | |
| KR | 1020050104613 | | 11/2005 | |
| KR | 1020050104613 | A | 11/2005 | |
| KR | 1020050104614 | | 11/2005 | |
| KR | 1020050104614 | A | 11/2005 | |
| KR | 1020060008365 | A | 1/2006 | |
| KR | 1020060018004 | A | 2/2006 | |
| KR | 1020060125952 | A | 12/2006 | |
| KR | 1020060125954 | A | 12/2006 | |
| KR | 1020080029824 | A | 4/2008 | |
| KR | 1020080039105 | A | 5/2008 | |
| KR | 1020100084127 | A | 7/2010 | |
| WO | 2004069021 | A | 8/2004 | |
| WO | 2007104138 | A1 | 9/2007 | |
| WO | 2007104238 | A1 | 9/2007 | |
| WO | 2008009883 | A1 | 1/2008 | |
| WO | 2008009887 | A1 | 1/2008 | |
| WO | 2008009888 | A1 | 1/2008 | |
| WO | 2008009890 | A1 | 1/2008 | |
| WO | 2008035032 | A2 | 3/2008 | |
| WO | 2008135708 | A1 | 11/2008 | |
| WO | 2010102394 | A1 | 9/2010 | |
| WO | 2010102396 | A1 | 9/2010 | |
| WO | 2012042240 | A1 | 4/2012 | |

OTHER PUBLICATIONS

English machine translation of KR1020030060539, published on Jul. 16, 2003.
English machine translation of KR1020060018004, published on Feb. 28, 2006.
English machine translation of KR1020060008365, published on Jan. 26, 2006.
English machine translation of KR1020050091835, published on Sep. 15, 2005.
English machine translation of KR1020050091836, published on Sep. 15, 2005.
English machine translation of KR1020050091834, published on Sep. 15, 2005.
English machine translation of KR1020050091833, published on Sep. 15, 2005.
English machine translation of KR1020050091829, published on Sep. 15, 2005.
English machine translation of KR1020050091824, published on Sep. 15, 2005.
English machine translation of KR1020050091821, published on Sep. 15, 2005.
English machine translation of KR1020050091826, published on Sep. 15, 2005.
English machine translation of KR1020100084127, published on Jul. 23, 2010.
English machine translation of KR1020080039105, published on May 7, 2008.
English machine translation of KR1020080029824, published on Apr. 3, 2008.
English machine translation of KR1020060125954, published on Dec. 7, 2006.
English machine translation of KR1020060125952, published on Dec. 7, 2006.
English machine translation of KR300360565, published on Sep. 1, 2004.
English machine translation of KR1020050104614, published on Nov. 3, 2005.
English machine translation of KR1020050104613, published on Nov. 3, 2005.
English machine translation of KR1020050103343, published on Oct. 31, 2005.
English machine translation of KR1020050091838, published on Sep. 15, 2005.
English machine translation of KR1020050091837, published on Sep. 15, 2005.
English machine translation of KR1020050091830, published on Sep. 15, 2005.
What's the Best Vacuum.com Forum discussion Dyson DC16 Root 6 Hand Held Vacuum Cleaner; http://www.abbysguide.com/vacuum/legacy/cgi-bin/yabb/2618-YaBB.html; dated Oct. 21, 2006.
"Instruction Manual for Cordless Cleaner", Makita, pp. 1-32.

(56) References Cited

OTHER PUBLICATIONS

International Search Report received on the corresponding International Application No. PCT/CA2010/000340, dated Jun. 25, 2010.
English machine translation of DE202005020767, published on Aug. 10, 2008.
English machine translation of DE102007011457, published on Oct. 25, 2007.
English machine translation of DE10110581, published on Nov. 13, 2003.
English machine translation of DE60201666, published on Jun. 1, 2006.
English machine translation of DE112010001135, published on Aug. 2, 2012.
English machine translation of DE112007003052, published on Jan. 14, 2010.
English machine translation of DE112007003039, published on Oct. 29, 2009.
English machine translation of DE112006003479, published on Dec. 18, 2008.
English machine translation of DE202011003563, published on May 19, 2011.
English machine translation of JP60220027, published on Nov. 2, 1985.
English machine translation of JP63246116, published on Oct. 13, 1988.
English machine translation of JP8289861, published on Nov. 5, 1996.
English machine translation of JP2004351234, published on Dec. 16, 2004.
English machine translation of JP2010227287, published on Oct. 14, 2010.
English machine translation of JP2010081968, published on Apr. 15, 2010.
English machine translation of JP2009261501, published on Nov. 12, 2009.
English machine translation of JP2004121722, published on Apr. 22, 2004.
English machine translation of JP61-131720, published on Jun. 19, 1986.
English machine translation of CN103169420, published on Jun. 26, 2013.
English machine translation of CN102256523, published on Nov. 23, 2011.
English machine translation of CN102188208, published on Sep. 21, 2011.
English machine translation of CN101822506, published on Sep. 8, 2010.
English machine translation of CN101657133, published on Feb. 24, 2010.
English machine translation of CN101489461, published on Jul. 22, 2009.
English machine translation of CN101489457, published on Jul. 22, 2009.
English machine translation of CN101489455, published on Jul. 22, 2009.
English machine translation of CN101489453, published on Jul. 22, 2009.
English machine translation of CN101448447, published on June3, 2009.
English machine translation of CN101288572, published on Oct. 22, 2008.
English machine translation of CN101095604, published on Jan. 2, 2008.
English machine translation of CN1969739, published on May 30, 2007.
English machine translation of CN1895148, published on Jan. 17, 2007.
English machine translation of CN101061932, published on Oct. 31, 2007.
English machine translation of CN101015436, published on Aug. 15, 2007.
English machine translation of CN1626025, published on Oct. 15, 2005.
English machine translation of CN202173358, published on Mar. 28, 2012.
English machine translation of CN201683850, published on Dec. 29, 2010.
English machine translation of CN85201464, published on Feb. 26, 1986.
English machine translation of CN201523596, published on Jul. 14, 2010.
English machine translation of CN203724037, published on Jul. 23, 2014.
English machine translation of CN201008534, published on Jul. 23, 2014.

* cited by examiner

HAND VACUUM CLEANER

CROSS-REFERENCE TO RELATED APPLICATIONS

This application claims benefit under 35 USC 120 as a continuation application of co-pending U.S. patent application Ser. No. 17/401,180, which was filed on Aug. 12, 2021 and is pending, which itself is a continuation application of co-pending U.S. patent application Ser. No. 15/015,036, which was filed on Feb. 3, 2016 and issued as U.S. Pat. No. 11,253,119 on Feb. 22, 2022, which itself is a continuation of U.S. patent application Ser. No. 13/255,858 which was filed on Sep. 9, 2011 and issued as U.S. Pat. No. 9,591,952 on Mar. 14, 2017, which was filed under 35 USC 371 as a national phase entry of international patent application No. PCT/CA2010/000340, with a filing date of Mar. 9, 2010, which itself claims the benefit of priority under 37 CFR 1.55 from Canadian patent application No. 2,658,029, filed on Mar. 11, 2009 and Canadian Patent application No. 2,658,048, filed on Mar. 11, 2009, the specifications of which are incorporated herein by reference.

FIELD

The specification relates to hand carried surface cleaning apparatus such as vacuum cleaners, and particularly, to cyclonic hand vacuum cleaners. More specifically, the specification relates to hand vacuum cleaners having a removable dirt chamber.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device, and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims.

According to one broad aspect, a hand surface cleaning apparatus is disclosed having a simplified structure for emptying the surface cleaning apparatus. The hand surface cleaning apparatus is preferably a cyclonic surface cleaning apparatus wherein the dirt chamber is removable as a sealed unit from the surface cleaning apparatus. The dirt chamber may be part of a cyclone (e.g., the lower portion of a cyclone chamber) and removable with the cyclone. Alternately, the dirt chamber may be external to the cyclone chamber and removable from the hand surface cleaning apparatus by itself. In either case, the dirt collection chamber is closed (other than, e.g., an air inlet, an air outlet, a dirt outlet) when removed from the hand surface cleaning apparatus. The dirt chamber may be openable, such as by an openable or removable lid or door. Accordingly, dirt collected in the chamber may be transported to a disposal site (e.g., a garbage can) without the dirt being dispersed as the dirt collection chamber is conveyed to the disposal site.

Another advantage of this design is that the dirt chamber, and the cyclone if removed with the dirt chamber, may be washed or immersed in water without concern that the motor of the hand surface cleaning apparatus may be damaged. The portion of the hand surface cleaning apparatus may be dried and then remounted to the hand surface cleaning apparatus so that the hand surface cleaning apparatus is then ready for further use.

In some examples, the hand surface cleaning apparatus may comprise an air flow passage extending from a dirty air inlet to a clean air outlet with a first cyclone unit positioned in the air flow passage. The first cyclone unit may comprise at least one cyclone and at least one dirt collection chamber. The dirt collection chamber may be a portion of the cyclone casing (e.g., a lower portion of a cyclone chamber or a chamber external to the cyclone casing and connected in flow communication with the cyclone chamber via a dirt outlet of the cyclone chamber. The dirt collection chamber is removable from the surface cleaning apparatus as a sealed unit for emptying. A suction motor is positioned in the air flow passage.

In some examples, the dirt collection chamber is removable from the hand surface cleaning apparatus with the first cyclone unit. The first cyclone unit may be sealed when removed from the hand surface cleaning apparatus other than fluid flow passages leading to and from the first cyclone unit.

In some examples, the first cyclone unit has a single cyclone and the dirt collection chamber is positioned exterior to the single cyclone. The cyclone and the dirt collection chamber may comprise a one-piece assembly, and may be integrally formed. For example, the dirt chamber and the cyclone chamber may be produced in a single mold, together optionally with an end wall. The other end, e.g., the bottom of the dirt chamber, may be closed by an openable door.

In some examples, the hand surface cleaning apparatus comprises a suction motor housing, the suction motor is positioned in the suction motor housing, and the first cyclone unit is removably mounted to the suction motor housing.

In some examples, the cyclone unit has a first mounting member, the suction motor housing has a second mounting member, and the first and second mounting members are rotationally secured together. Preferably, a bayonet mount is used. However, a screw mount or other means, such as latches or other hand operable releasable mechanical fasteners, may be used.

In some examples, the at least one dirt collection chamber is openable when mounted to the hand surface cleaning apparatus.

In some examples, the hand surface cleaning apparatus has a front end and a rear end, the first cyclone unit is positioned forward of the suction motor housing, and the at least one dirt collection chamber has an openable door positioned at the front end.

In some examples, the hand surface cleaning apparatus further comprises an airflow chamber extending from a dirty air inlet to the cyclone wherein the airflow chamber is removable with the first cyclone unit. The airflow chamber may be integrally formed as part of the first cyclone unit.

In some examples, the first cyclone unit has a single cyclone and a single dirt collection chamber. In other examples, the hand surface cleaning apparatus further comprises a second cyclone unit downstream from the first cyclone unit.

According to another broad aspect, a hand surface cleaning apparatus is disclosed that is easier to clean and has a simplified structure. In accordance with this aspect, a hand surface cleaning apparatus is provided with a dirt collection chamber and a nozzle. The nozzle and the dirt collection chamber may be integrally molded together or separately manufactured and then assembled together as a one-piece assembly. In either embodiment, the nozzle and the dirt collection chamber may then be removed concurrently (e.g., in a single operation) from the hand surface cleaning apparatus. Once removed, the dirt collection chamber may be emptied. During operation, dirt may build up in the nozzle of the surface cleaning apparatus and/or the dirt collection chamber. These components once separated from the hand surface cleaning apparatus may be cleaned by, for example, washing them in water.

In a preferred embodiment, the dirt collection chamber is removable in a sealed configuration. For example, a cyclone unit may comprise a cyclone and a dirt collection chamber assembly. The assembly may be removably mounted to the hand surface cleaning apparatus. Accordingly, the dirt collection chamber may be closed (e.g., have a closed lid) when removed from the hand surface cleaning apparatus.

A further advantage of this design is that the hand surface cleaning apparatus may have a simplified structure. By providing the nozzle as part of the dirt collection chamber, and preferably as part of a cyclone unit, such an assembly may be removably mounted to a motor housing. Accordingly, a skeleton or backbone to which individual components are mounted is not required and is preferably not used. Such a design may be lighter, permitting a user to use the hand surface cleaning apparatus for a longer continuous period of time.

Accordingly, for example, the hand surface cleaning apparatus may comprise an air flow passage extending from a nozzle having a dirty air inlet to a clean air outlet, with a first cyclone unit is positioned in the air flow passage. The first cyclone unit may comprise at least one cyclone having a cyclone inlet and at least one dirt collection chamber. A suction motor may be positioned in the air flow passage. The dirt collection chamber and the nozzle are removable from the surface cleaning apparatus, preferably concurrently (i.e., by the same operation step).

In some examples, the dirt collection chamber and the nozzle are removable as a unit.

In some examples, the dirt collection chamber and the nozzle comprise a one-piece assembly.

In some examples, the dirt collection chamber and the nozzle are integrally formed, such as being produced from a single mold.

In some examples, the dirt collection chamber is removable from the hand surface cleaning apparatus with the first cyclone unit.

In some examples, the nozzle is connected in airflow communication with the cyclone at a lower portion of the hand surface cleaning apparatus.

In some examples, the nozzle is positioned at a bottom of the hand vacuum.

In some examples, the nozzle is positioned beneath at least a portion of the cyclone unit.

In some examples, the hand surface cleaning apparatus further comprises a plurality of wheels, and the nozzle has a nozzle axis that extends generally horizontally when the wheels are in contact with a surface to be cleaned.

In some examples, the nozzle comprises an enclosed airflow chamber.

In some examples, the nozzle comprises an open sided airflow chamber.

In some examples, the open sided airflow chamber has an open lower end.

In some examples, the open sided airflow chamber has an upper nozzle wall that comprises at least a portion of the lower wall of the cyclone unit.

In some examples, the cyclone inlet is in communication with an enclosed passage extending from an opening in the upper nozzle wall.

In some examples, the open sided airflow chamber further comprises a depending wall extending downwardly from the upper nozzle wall.

In some examples, the depending wall is generally U-shaped.

In some examples, the hand surface cleaning apparatus has a front and the open sided airflow chamber extends to the front of the hand surface cleaning apparatus and the dirty air inlet is at the front of the hand surface cleaning apparatus.

In some examples, the cyclone inlet faces a surface to be cleaned.

In some examples, the open sided airflow chamber comprises an upper wall. A depending wall may extend downwardly from the upper wall. The depending wall may have a lower end that is positioned above the lower end of the wheels. The upper wall and the depending wall may define an airflow chamber having an open lower end. The opening may be provided in a rear half of the upper wall of the air flow chamber forwardly of a rear portion of the depending wall and inwardly of side portions of the depending wall.

It will be appreciated that a hand surface cleaning apparatus may incorporate one or more of the features of each of these examples and that each of these is within the scope of the invention, including the openable front door, the removable screen, the door being at the front of the hand surface cleaning apparatus, the open sided nozzle.

DRAWINGS

In the detailed description, reference will be made to the following drawings, in which.

DESCRIPTION OF VARIOUS EXAMPLES

Figure 1:
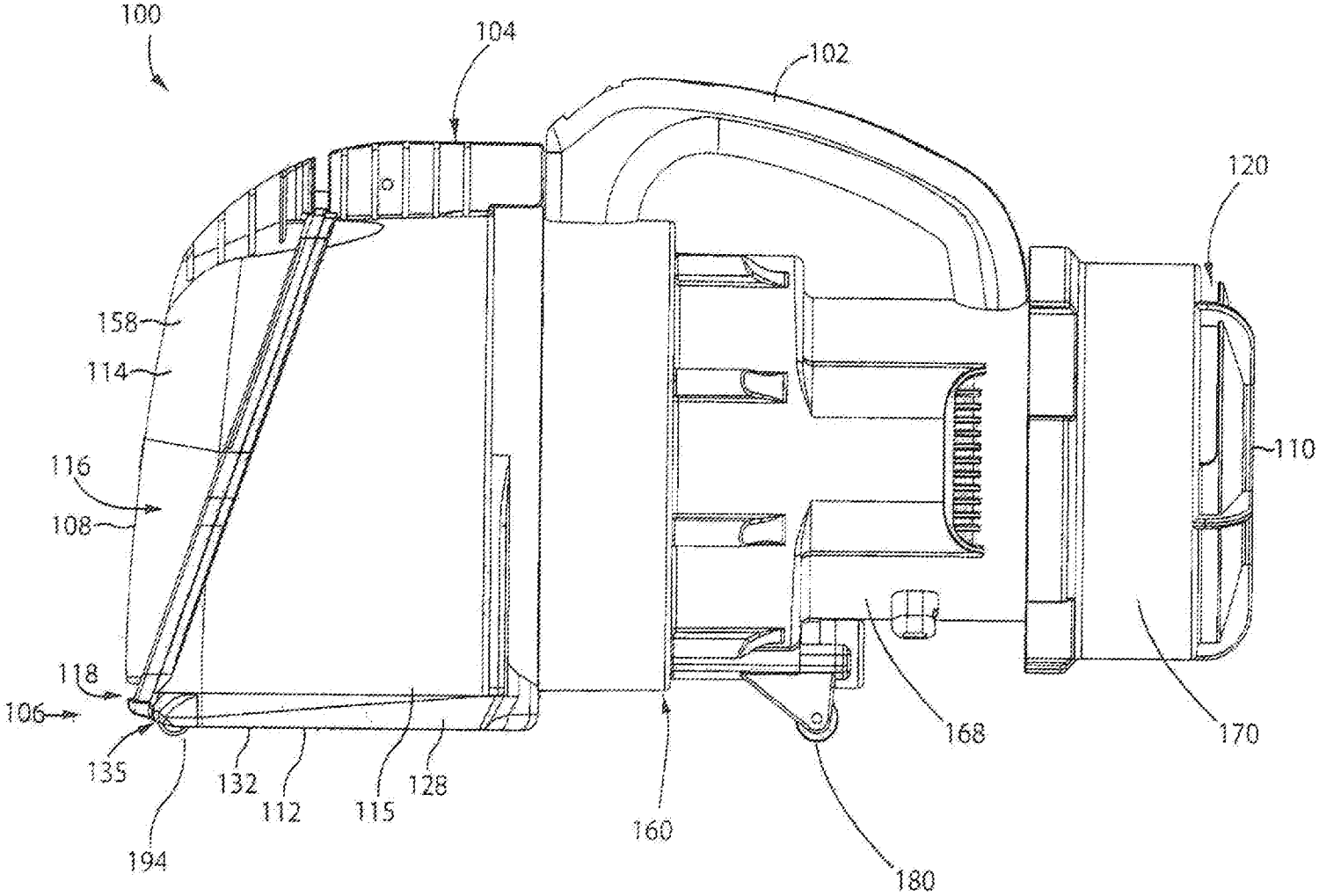
FIG. 1 is a side plan view of an example of a hand vacuum cleaner.
Figure 2:
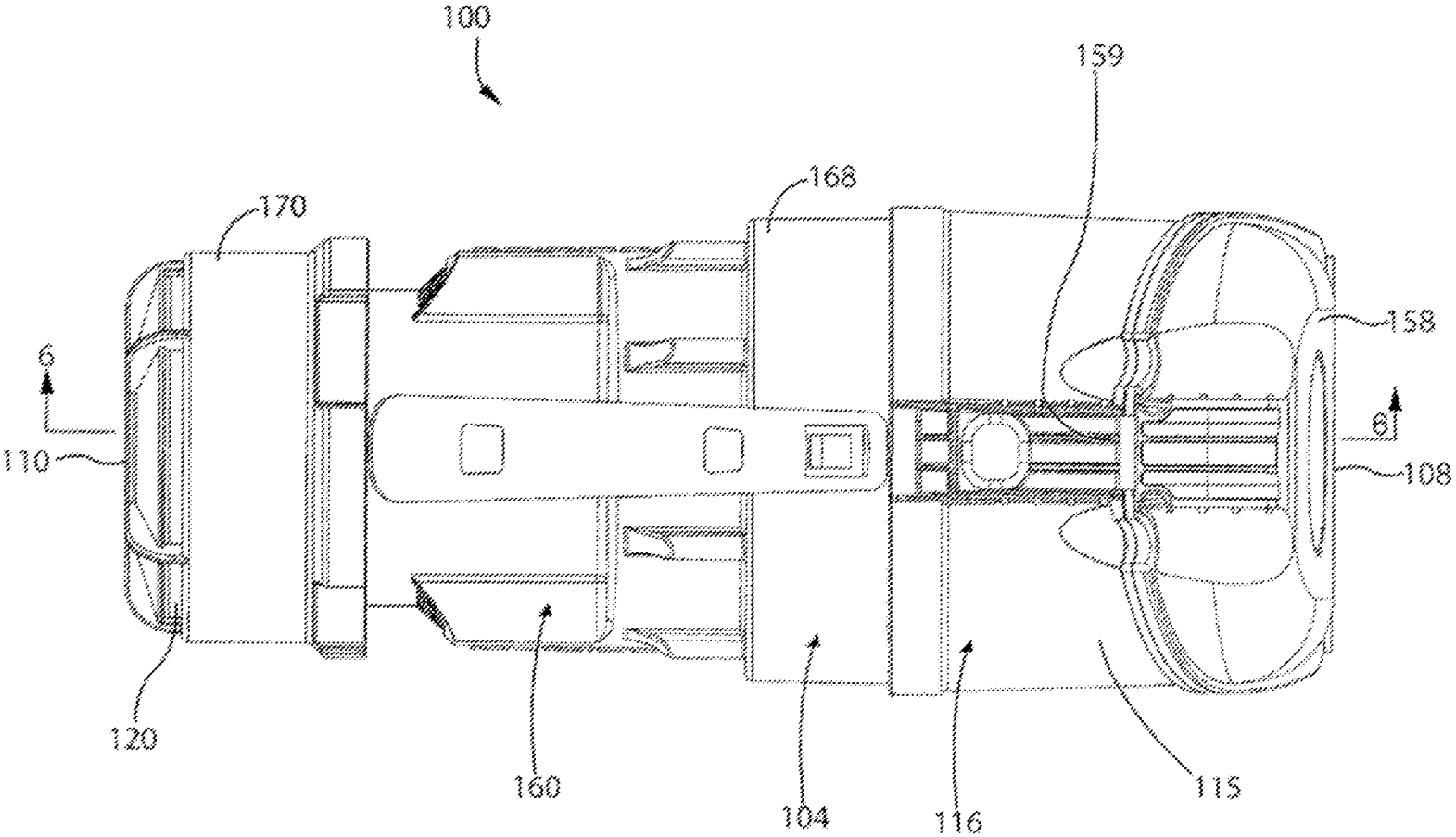
FIG. 2 is a top plan view of the hand vacuum cleaner of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below.

In the drawings attached hereto, the surface cleaning apparatus is exemplified as used in a hand vacuum cleaner that uses a single cyclone axially aligned with a longitudinal axis of the hand vacuum cleaner. It will be appreciated that the vacuum cleaner 100 may be of various configurations (e.g., different positioning and orientation of the cyclone unit and the suction motor and differing cyclone units that may comprise one or more cyclones and one or more filters) and different types of surface cleaning apparatus, such as a wet/dry hand held surface cleaning apparatus.

Referring to FIGS. 1 to 7B, a first example of a vacuum cleaner 100 is shown. The vacuum cleaner 100 is a hand vacuum cleaner, and is movable along a surface to be cleaned by gripping and maneuvering handle 102. The vacuum cleaner includes an upper portion 104, a lower portion 106, a front 108, and a rear 110. In the example shown, handle 102 is provided at the upper portion 104. In alternate examples, handle 102 may be provided elsewhere on the vacuum cleaner 100, for example at the rear 110 and may be of any design.

In the example shown, the vacuum cleaner 100 comprises a nozzle 112 and a cyclone unit 114, which, in one embodiment, together form a surface cleaning head 116 of the vacuum cleaner 100. In the example shown, the surface cleaning head 116 is preferably provided at the front 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is preferably at the rear 110 of the cleaner 100.

Cyclone unit 114 is provided in the airflow passage, downstream of the dirty air inlet 118. In the example shown, the cyclone unit 114 is a one piece assembly comprising one cyclone 122, and one dirt collection chamber 124, which are preferably integrally formed. In alternate examples, the cyclone unit 110 may include more than one cyclonic stage, wherein each cyclonic stage comprising one or more cyclones and one or more dirt chambers. Accordingly, the cyclones may be arranged in parallel and/or in sequence. Further, in alternate examples, the cyclone 122 and dirt collection chamber 124 may be separately formed.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. Further, as exemplified, the nozzle 112 may be integral formed as port of cyclone unit 114 or may be a one-piece assembly therewith (e.g., separately manufactured but assembled together such as by an adhesive or welding to form a single component). Alternately, or in addition, it will be appreciated that nozzle 112 may be connected to the cyclone unit or dirt collection chamber at alternate locations.

Figure 6:
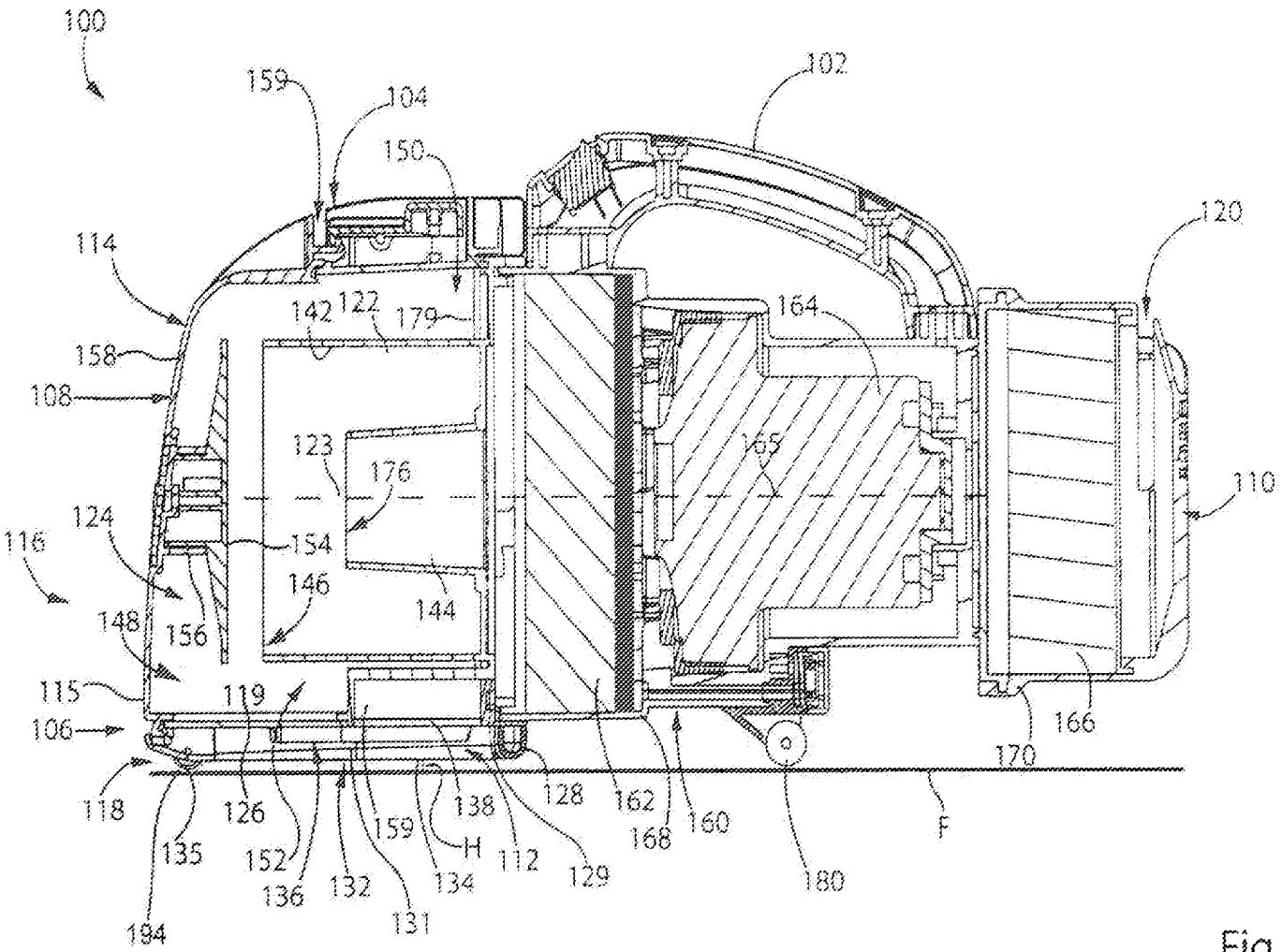
FIG. 6 is a cross section taken along line 6-6 in FIG. 2.

Preferably, as exemplified, nozzle 112 may be on lower surface 157 of cyclone unit 114 and may share a wall with the cyclone unit 114. For example, in a particularly preferred design, the upper wall of the nozzle may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122. In alternate embodiments, nozzle 112 and cyclone 122 or dirt chamber 124 need not have a common wall.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
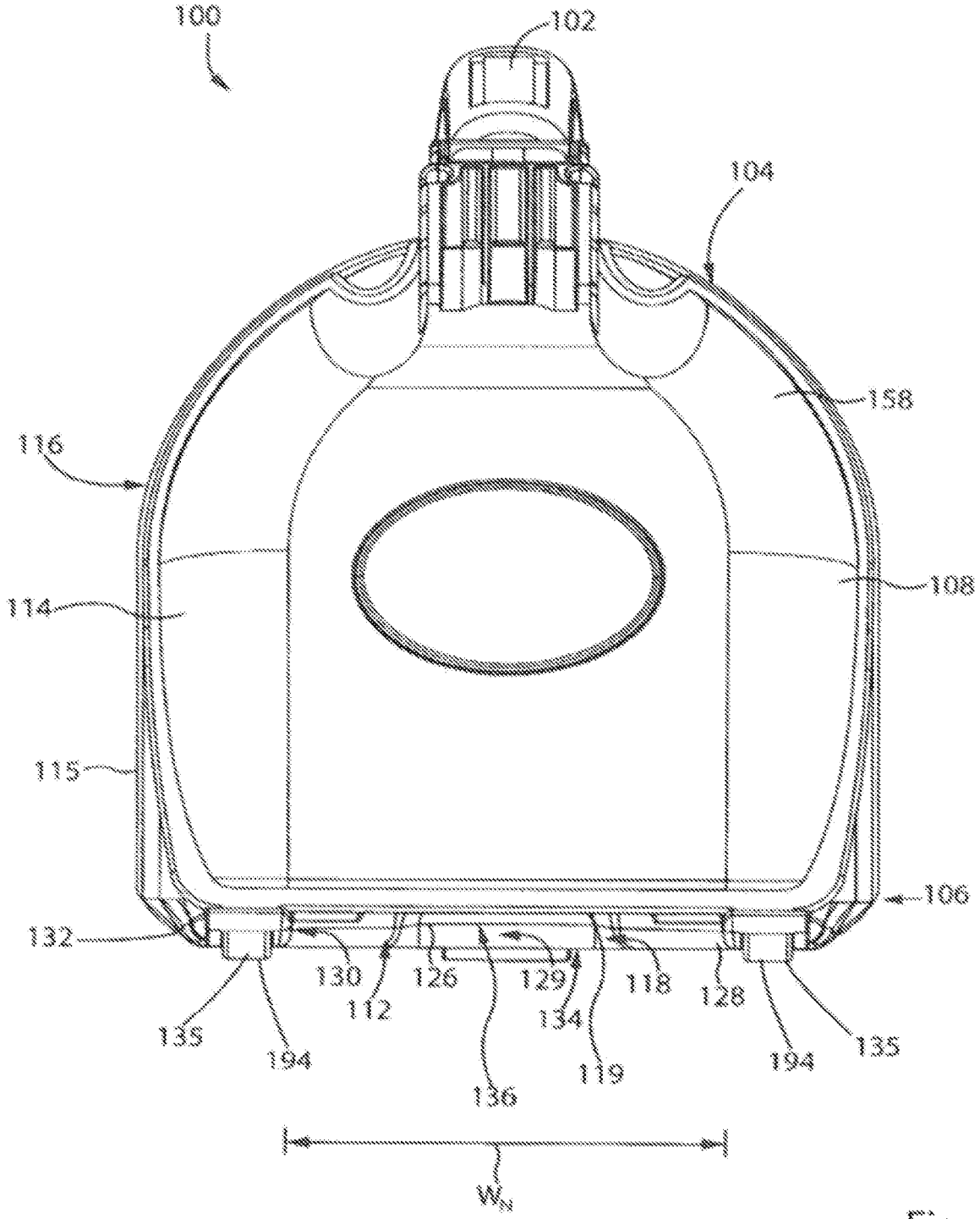
FIG. 3 is a front plan view of the hand vacuum cleaner of FIG. 1.
Figure 5:
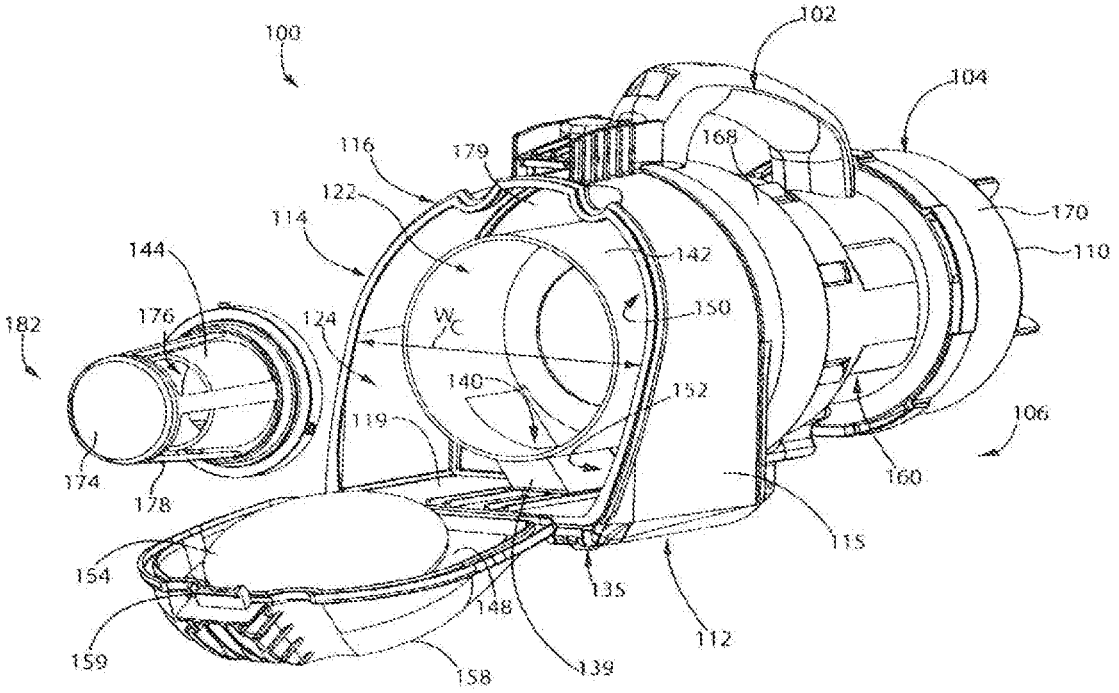
FIG. 5 is a partially exploded front perspective view of the hand vacuum cleaner of FIG. 1.

As shown in FIGS. 3 and 5, nozzle 112 has a width $W_N$, and cyclone unit 114 has a width $W_c$. In the example shown, $W_N$, and $W_c$ are about the same. An advantage of this design is that the nozzle 112 may have a cleaning path that is essentially as wide as the hand vacuum itself.

Preferably, nozzle 112 comprises an airflow chamber 136 wherein at least a portion, and preferably a majority, of the lower surface of the chamber is open (i.e. nozzle 112 is preferably an open sided passage). Such a design is exemplified in FIG. 7A wherein nozzle 112 comprises an upper nozzle wall 126. In the example shown, the upper nozzle wall 126 comprises a portion 119 of a wall 115 of the cyclone unit. Accordingly, nozzle 112 is integral with cyclone unit 114.

Figure 8:
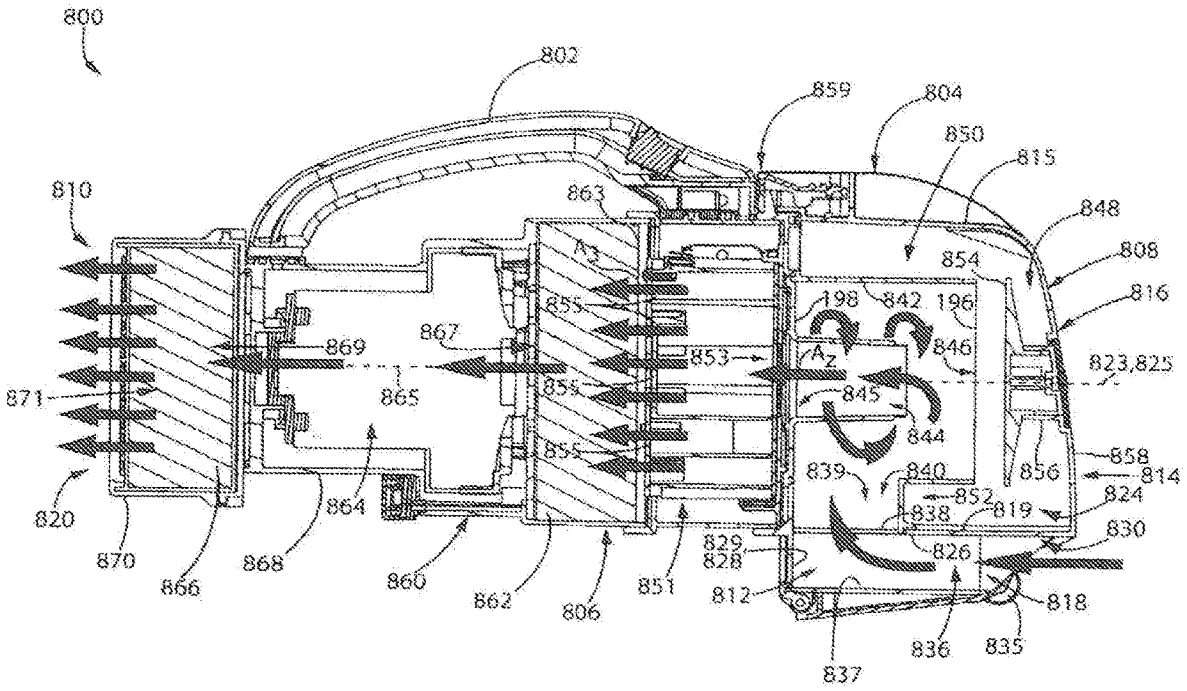

An alternate design as exemplified by FIG. 8, nozzle 812 comprises a lower wall 837, which closes lower end 834. Accordingly, nozzle 112 may be of various designs and may be an open sided passage or a closed passage. In either embodiment, it will be appreciated that nozzle 112 may be mounted or provided on cyclone unit 114 and as exemplified on a lower portion of the dirt collection chamber so as to be removable with the dirt collection chamber.

Preferably, if nozzle 112 is an open sided passage, one or more depending walls 128 extend downwardly from the upper nozzle wall 126. The depending wall is preferably generally U-shaped. In one embodiment, a depending wall is provided rearward of opening 138. In other embodiments, depending walls may alternately or in addition be provided on the lateral sides of opening 138. It is preferred that depending walls are provided on each lateral side of opening 138 and rearward thereof. Further, depending walls 128 may extend a substantial distance to the front end 108 and, preferably, essentially all the way to front end 108. The depending walls may be continuous to define a single wall as shown, or may be discontinuous. The depending walls are preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 to 0.175 inches, more preferably from 0.04 to 0.08 inches.

The height of the depending wall (between upper nozzle wall 126 and lower end 132) may vary. In some examples, the depending wall may have a height of between about 0.05 and about 0.875 inches preferably between about 0.125 and about 0.6 inches and more preferably between about 0.2 and about 0.4 inches. The height of depending wall may vary but is preferably constant.

As exemplified, the open end of the U-shape defines an open side 130 of the nozzle 114, and forms the dirty air inlet 118 of the cleaner 100. In the example shown, the open side 130 is provided at the front of the nozzle 114. In use, when optional wheels 135 are in contact with a surface, the open side 130 sits above and is adjacent a surface to be cleaned (e.g. floor F).

In the example shown, the lower end 132 of the depending wall 128 defines an open lower end 134 of the nozzle 114. The open lower end 134 preferably extends to the front 108 of the cleaner 108, and merges with the open side 130. In use, the exemplified nozzle has an open lower end 134 that faces a surface to be cleaned.

In the example shown, a plurality of wheels 135 are mounted to the depending wall 128. It will be appreciated that wheels 135 are optional. Preferably, wheels 135 are positioned exterior to the airflow path through nozzle 112, e.g., laterally outwardly from depending wall 128. Preferably a pair of front wheels 135 is provided. Preferably, the wheels are located adjacent front 108. Optionally, one or more rear wheels 180 may be provided. In an alternate embodiment, no wheels may be provided. If wheels are provided, then preferably the wheels 135, and more specifically the lower end 194 of the wheels 135, extend lower than the lower end 132 of the depending wall 128. That is, the lower end 132 of the depending wall 128 is positioned above the lower end 194 of the wheels 135. Accordingly, in use, when wheels 135 are in contact with a surface, the lower end 132 of the depending wall 128 is spaced from a surface to be cleaned, Accordingly, some air may enter nozzle 114 by passing underneath depending wall 132. In such a case, the primary air entry to nozzle 114 is via open side 130 so that dirty air inlet 118 is the primary air inlet, and the space between the lower end of the depending wall 128 and the surface to be cleaned form a secondary dirty air inlet to the cleaner 100 (i.e. the secondary air inlet is under depending wall 128).

The upper nozzle wall 126, depending wall 128, and open lower end 134 of the nozzle 112 define the open sided airflow chamber 136 of the nozzle. In the example shown, the open sided airflow chamber 136 extends to the front 108 of the cleaner 100. In use, when wheels 135 are in contact with a horizontal surface, the nozzle 112 and the airflow chamber 136 extend generally horizontally, and preferably linearly along a nozzle axis 113 (see FIG. 7A).

If an open sided nozzle 112 is used, then an opening 138 may be provided in the upper nozzle wall 126, in communication with the airflow chamber 136. Opening 138 may be of any size and configuration and at various locations in upper nozzle wall 126. Preferably, opening 138 is positioned in the rear half of upper nozzle wall 126, forwardly of a rear portion 129 of depending wall 128. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is enclosed, and which is in communication with a cyclone air inlet 140 of cyclone 122. In use, when wheels 135 are in contact with a surface, cyclone air inlet 140 faces a surface to be cleaned. Accordingly, the nozzle 112 is connected in airflow communication with the cyclone 112 at the lower portion 106 of the cleaner 100.

Cyclone 122 may be of any configuration and orientation. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and preferably extends generally horizontally when cleaner 100 is in use and wheels 135 are seated on a surface. Cyclone 122 has a front end 196, which is towards, and preferably at the front end 108 of the hand vacuum cleaner and a rear end 198. The cyclone 122 has an air inlet 140 and an air outlet 145 which, preferably are at the same end of cyclone 122 and a dirt outlet is preferably provided at the opposite end. Preferably the air inlet and the air outlet are distal to front end 108 and a dirt outlet is proximate the front end 108. The cyclone air inlet and cyclone air outlet may be of any configuration known in the art and the cyclone air outlet may be covered by a screen or shroud or filter as is known in the art.

As exemplified, the cyclone air inlet 140 is defined by an aperture in the chamber wall 142. As can be seen in FIG. 5, the inlet passage 139 is configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144, through outlet 145. Outlet 145 is defined in a rear wall 179 of the cyclone unit 114.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt collection chamber 124. Dirt collection chamber 124 may be any dirt collection chamber. Preferably, as exemplified, dirt outlet is at the front 196 of the cyclone 122, and further, is at the front end 108 of the cleaner 100. The dirt collection chamber may be internal or external to the cyclone chamber. Preferably, as exemplified, the dirt collection chamber is external. The dirt collection chamber may be in communication with the cyclone chamber by any means known in the art. Accordingly, one or more dirt outlets may be provided. Preferably, the dirt outlet is at the end opposed to the air inlet and, preferably, the dirt outlet is at the front end 108. Preferably, the dirt outlet is at the end opposed to the air inlet and, preferably, the dirt outlet is at the front end 108

In the example shown, dirt collection chamber 124 preferably comprises two portions. A first portion 148 is provided immediately adjacent the dirt outlet 146, and is at the front 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt collection chamber 124, adjacent the dirt outlet 146, and in facing relation to the dirt outlet. The separation plate 154 aids in preventing dirt in dirt collection chamber 124 from re-entering cyclone 122. Preferably, plate 154 is spaced from dirt outlet 146 and faces dirt outlet 146. Plate 154 may be mounted by any means to any component in cyclone unit 114. As exemplified, the separation plate is mounted on an arm 156, which extends from a front wall 158 at the front 108 of the cleaner 100.

Cyclone unit 114 may be emptied by any means known in the art. For example, one of the ends of the cyclone unit 114 may be openable. For example, one of the ends of the cyclone unit 114 may be openable. In an embodiment, an openable door may be positioned at the front end of the vacuum cleaner and preferably comprises a front wall thereof. The door may be opened while the cyclone unit or the dirt collection chamber 124 is mounted to the vacuum cleaner. Alternately, or in addition, the door may be opened when the cyclone unit or the dirt collection chamber 124 has been removed from the vacuum cleaner. The door may be openably mounted to the cyclone unit, dirt collection chamber 124 or another portion of vacuum cleaner 100 by any means known in the art. For example, one or more latches 159 may secure the door in position. Alternately, the door may be opened, e.g., pivoted open, and then optionally removable. It will be appreciated that, in an embodiment wherein cyclone unit 114 is not removed as a sealed unit, dirt collection chamber 124 may be removed with nozzle 112.

Figure 4:
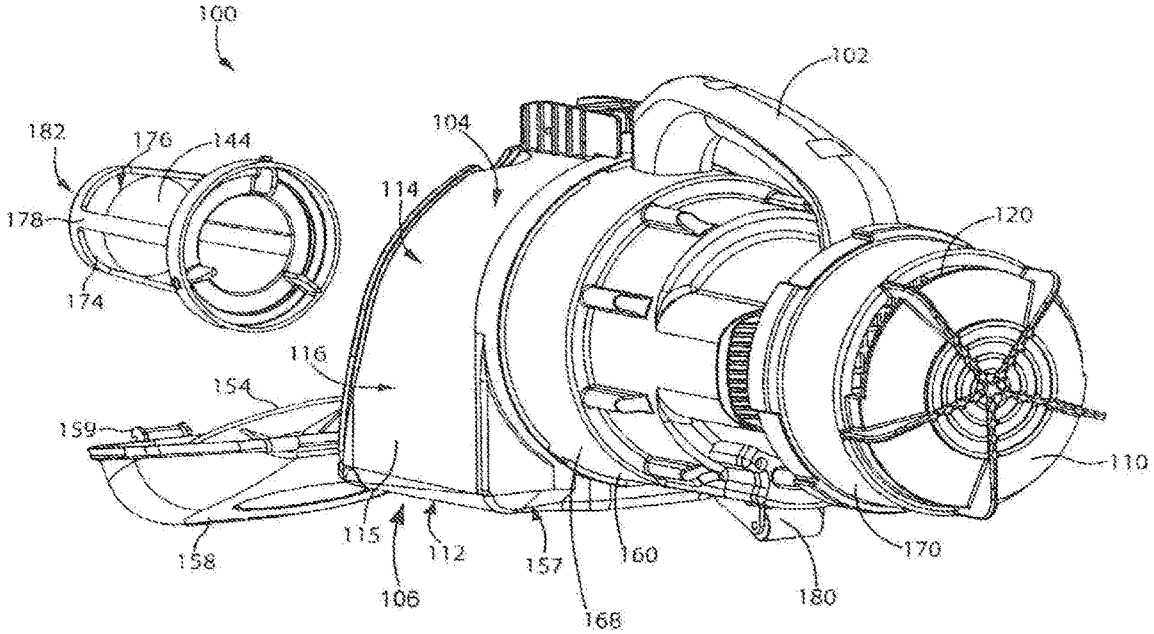
FIG. 4 is a partially exploded rear perspective view of the hand vacuum cleaner of FIG. 1.

As exemplified in FIGS. 4 and 5, front wall 158 is pivotally mounted to the cyclone unit wall 115 and serves as an openable door of the dirt chamber 124, such that dirt collection chamber 124 is openable, and dirt collection chamber 124 may be emptied. The dirt collection chamber is therefore preferably openable both, when the dirt collection chamber is mounted to the hand vacuum cleaner, or when it is removed, as will be described hereinbelow. When front wall 158 is pivoted away from the remainder of the cyclone unit 114, separation plate 154 and arm 156 also pivot away from the remainder of the cyclone unit. A latch 159 is provided, which secures front wall 158 to wall 115. In alternate examples, front wall 158 may be removable from cyclone unit wall 115, or the rear wall 179 of the cyclone unit 114 may be openable.

The rear portion of the dirt collection chamber 124 may be closed by wall 179.

The clean air exiting cyclone 122 passes through outlet 145 of outlet passage 144, exits surface cleaning head 116, and passes into the cleaner body 160. In the example shown, the cleaner body 160 is positioned rearward of the surface cleaning head 116. The cleaner body comprises a suction motor housing 168, which houses a suction motor 164 and may also house an optional pre-motor filter 162 and/or an optional post-motor filter 166.

In the example shown, suction motor housing 168 further houses a pre-motor filter 162. Preferably, as shown in the exemplified embodiments, the vacuum cleaner has a linear configuration. Accordingly, pre-motor filter 162 is provided in the airflow path adjacent and downstream of the outlet passage 144, and facing the outlet 145. Pre-motor filter 162 serves to remove remaining particulate matter from air exiting the cyclone 122, and may be any type of filter, such as a foam filter. One or more filters may be used. If the vacuum cleaner is of a non-linear configuration, then pre-motor filter 162 need not be located adjacent outlet passage 144.

Suction motor 164 is provided in the airflow path preferably adjacent and downstream of the pre-motor filter 162. The suction motor 164 may be any type of suction motor. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 123 preferably extend in the same direction and are preferably generally parallel. In the exemplified embodiments, the vacuum cleaner has a linear configuration. If the vacuum cleaner is of a non-linear configuration, then motor 164 need not be located adjacent pre-motor filter 162.

The cleaner body 160 preferably further comprises a post-motor filter housing 170. A post motor filter 166 is provided in the post-motor filter housing 170. The post motor filter 166 is provided in the airflow path downstream of, and preferably adjacent, the suction motor 164. Post motor filter 166 serves to remove remaining particulate matter from air exiting the cleaner 100. Post-motor filter 166 may be any type of filter, such as a HEPA filter. If the vacuum cleaner is of a non-linear configuration, then post motor filter 166 need not be located adjacent suction motor 164.

Clean air outlet 120 is provided downstream of post-motor filter 166. Clean air outlet 120 may comprise a plurality of apertures formed in housing 170.

Figure 7A:
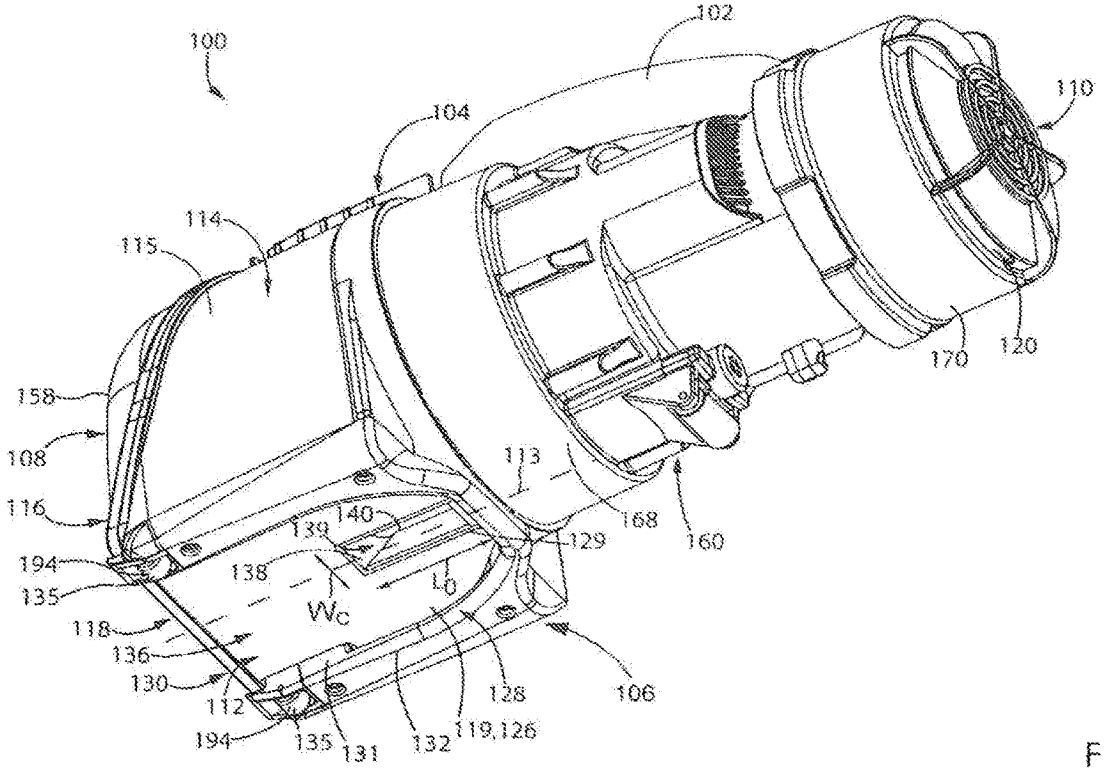
FIG. 7A is a bottom perspective view of the hand vacuum cleaner of FIG. 1.
Figure 7B:
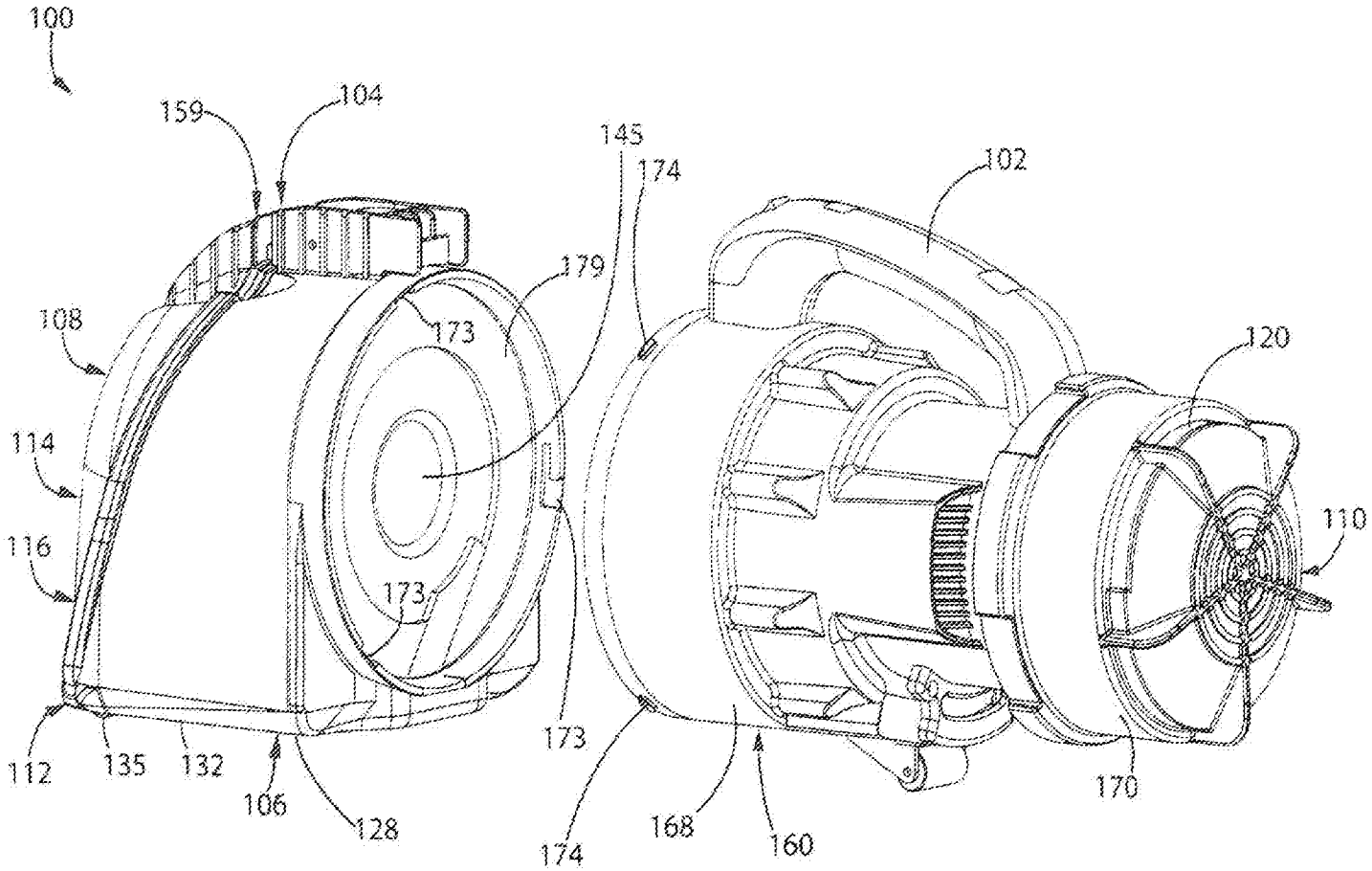
FIG. 7B is a rear perspective view of the hand-vacuum cleaner of FIG. 1, showing the cyclone unit removed from the hand vacuum cleaner; and, FIG. 8 is a cross section showing an alternate example of a hand vacuum cleaner.

As exemplified in FIG. 7B, in one aspect of this invention, the dirt collection chamber 124 is removable from the hand vacuum cleaner 100 as a sealed unit for emptying. It will be appreciated that this aspect may be used by itself or in any particular combination or sub-combination of any one or more of the features set out herein.

In accordance with another aspect of the invention, when cyclone unit 114 is removed from the cleaner 100, nozzle 112 is also removed from the cleaner 100. It will be appreciated that this aspect may be used by itself or in any particular combination or sub-combination of any one or more of the features set out herein. In one particular embodiment, both aspects may be used.

For example, in the example shown, the dirt collection chamber 124 is integrally formed with cyclone wall 142, and with nozzle 112, and the cyclone unit 114 comprises the dirt collection chamber 124. Accordingly, the cyclone unit 114 is removable from the hand vacuum cleaner. As the cyclone unit 114 is integral with nozzle 112 and airflow chamber 136, nozzle 112 and airflow chamber 136 are removable from the cleaner 100 with cyclone unit 114.

In other embodiments, one or more of these components may be separately manufactured and then assembled together (e.g., by an adhesive, mechanical means such as screws or welding, to form a one-piece assembly.

It will be appreciated that if dirt chamber 124 is removably mounted to cyclone unit 114, then nozzle 112 is removable together with dirt chamber 124 from vacuum cleaner 100. It will be appreciated that this aspeet may be used by itself or in any particular combination or sub-combination of any one or more of the features set out herein.

In other embodiments, the dirt collection chamber 124 may be removable from the hand vacuum cleaner 100 alone, without the cyclone unit 114 or the nozzle 112.

As can be seen in FIG. 7B, when the cyclone unit 114 is removed from the hand vacuum cleaner, and particularly from motor housing 168, it is sealed, except for the fluid flow passages leading to and from the first cyclone unit (i.e. opening 138 and outlet 145). That is, wall 179 seals the air outlet end of cyclone unit 114 and front wall 158 seals the front end of the cyclone unit 114. In order to empty the dirt collection chamber 124, the front wall 158 or the rear wall 179 may be opened, and the dirt may be emptied from dirt chamber 124.

As exemplified, in order to remove cyclone unit 114 from the surface cleaning apparatus, the cyclone unit comprises a first mounting member 173, and the suction motor housing 168 has a second mounting member 175. The first 173 and second 175 mounting members are releasably engageable with each other. In the example shown, the first 173 and second 175 mounting members comprise a bayonet mount. In alternate examples, the first and second mounting members may be another type of mounting member, such as mating screw threads, magnets, mechanical fasteners such as screws or any other type of mounting members. It will be appreciated that if dirt collection chamber 124 is removably mounted to cyclone unit 114, then any such removable securing mechanism may be used.

Removing the cyclone unit 114 from the hand vacuum cleaner may be advantageous, because it may allow a user to wash the cyclone unit 114, for example using water, without risking wetting and shorting the suction motor 164.

One or more additional wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Referring now to FIG. 8, in which like numerals refer to like features, with the first digit incremented to 8 to refer to the figure number, an alternate example of a hand vacuum cleaner 800 is shown. As discussed previously, nozzle 812 comprises a lower wall 837, which closes lower end 834. Accordingly, in contrast to cleaner 100, nozzle 812 comprises an enclosed airflow passage 836. Further, in this example, front wall 858 is not pivotally mounted to wall 815. Rather, wall surface cleaning head 816 is pivotally mounted to body 860.

Cleaner 800 may further comprise a second optional cyclone unit 851 downstream of the first cyclone unit 814, between first cyclone unit 814 and pre-motor filter 862. In the example shown, the second cyclone unit 851 comprises a plurality of cyclones in parallel. Each of the plurality of cyclones is parallel to the first cyclone axis 823.

The invention claimed is:

1. A hand vacuum cleaner having a front end, a rear end, an upper side and a lower side, the hand vacuum cleaner comprising:

(a) an air flow passage extending from a dirty air inlet provided at the front end to a clear air outlet provided at the rear end;

(b) a cyclonic unit comprising a first cyclonic stage, the first cyclonic stage comprising a first stage cyclone having a front end, a rear end, a cyclone axis of rotation extending between the front and rear ends of the cyclone and an axially extending cyclone wall which extends to the front end of the first cyclonic stage, the front end comprising a front door that is moveable between a closed position and an open position;

(c) the cyclonic unit further comprising a second cyclonic stage downstream of the first cyclonic stage, the second cyclonic stage comprising a plurality of cyclones, wherein the cyclone axis of rotation extends through a central portion of the second cyclonic stage;

(d) a vacuum cleaner body comprising a suction motor that is positioned in the air flow passage;

(e) a handle; and, (f) a latch securing the front door in the closed position, wherein the front door has a first portion which is rotatably mounted to a front end of the cyclone unit wall and a second portion angularly spaced around the front door from the first portion, the second portion having the latch.

2. The hand vacuum cleaner of claim 1 wherein, when the front door is in an open position, the front door opens a cyclone chamber and a dirt collection chamber.

3. The hand vacuum cleaner of claim 1 wherein when the hand vacuum cleaner is oriented such that the cyclone axis of rotation is horizontal and the upper side is above the lower side, the first portion is provided at the lower side of the hand vacuum cleaner.

4. The hand vacuum cleaner of claim 1 wherein the first stage cyclone has an open end that is closed by the front door, wherein all of the open end is opened when the front door is in the open position.

5. The hand vacuum cleaner of claim 1 further comprising a latch engagement member releasably engageable with the latch, the latch engagement member extending axially and having an actuator adjacent a forward end of the handle.

6. The hand vacuum cleaner of claim 1 wherein an end of a hand grip portion of the handle is located rearward of the first stage cyclone.

7. The hand vacuum cleaner of claim 1 wherein the front door has a diameter and the rear end of the first cyclonic stage has a diameter that is generally equal to the diameter of the front door.

8. A hand vacuum cleaner having a front end, a rear end, an upper side and a lower side, the hand vacuum cleaner comprising:

(a) an air flow passage extending from a dirty air inlet provided at the front end to a clear air outlet provided at the rear end;

(b) a vacuum cleaner body comprising a suction motor positioned in the air flow passage, a front end, a rear end and a handle;

(c) a cyclone unit positioned in the air flow passage upstream from the suction motor, the cyclone unit comprising a cyclone having a front end, a rear end, a cyclone axis of rotation extending between the front and rear ends of the cyclone, the cyclone unit further comprising an axially extending cyclone unit wall which extends to a front end of the cyclone unit, the front end of the cyclone unit comprising a front door that is moveable between a closed position and an open position; and, (d) a latch securing the front door in the closed position, wherein the front door has a first portion which is rotatably mounted to a front end of the cyclone unit wall and a second portion angularly spaced around the front door from the first portion, the second portion having the latch, wherein the cyclone unit wall terminates at an open end, the open end is closed by the front door, wherein all of the open end is opened when the front door is in the open position.

9. The hand vacuum cleaner of claim 8 wherein, when the front door is in an open position, the front door opens a cyclone chamber and a dirt collection chamber.

10. The hand vacuum cleaner of claim 8 wherein when the hand vacuum cleaner is oriented such that the cyclone axis of rotation is horizontal and the upper side is above the lower side, the first portion is provided at the lower side of the hand vacuum cleaner.

11. The hand vacuum cleaner of claim 8 wherein the latch is securable to the cyclone unit wall.

12. The hand vacuum cleaner of claim 8 further comprising a latch engagement member releasably engageable with the latch, the latch engagement member having an actuator adjacent a forward end of the handle.

13. The hand vacuum cleaner of claim 12 wherein an end of a hand grip portion of the handle is located rearward of the cyclone.

14. The hand vacuum cleaner of claim 13 wherein the latch engagement member extends axially.

15. The hand vacuum cleaner of claim 8 wherein the front door rotates forwardly to an open position.

16. The hand vacuum cleaner of claim 8 wherein the cyclone unit comprises a first cyclonic stage, the front door has a diameter and the rear end of the first cyclonic stage has a diameter that is generally equal to the diameter of the front door.

17. The hand vacuum cleaner of claim 8 wherein the cyclone unit wall is moveable relative to the vacuum cleaner body.

18. The hand vacuum cleaner of claim 8 wherein the cyclone unit comprises a first cyclonic stage and a second cyclonic stage downstream of the first cyclonic stage, the first cyclonic stage comprising the cyclone, the second cyclonic stage comprising a plurality of cyclones, wherein the cyclone axis extends through a central portion of the second cyclonic stage.

19. The hand vacuum cleaner of claim 18 wherein, when the front door is in an open position, the front door opens the cyclone and a dirt collection chamber.

* * * * *